United States Patent [19]

Okabe et al.

[11] Patent Number: 4,770,137

[45] Date of Patent: Sep. 13, 1988

[54] CYLINDER CONTROL DEVICE FOR VARIABLE-CYLINDERED ENGINE

[75] Inventors: Yoshio Okabe, Chiryu; Yukimori Kobayashi, Gamagori, both of Japan

[73] Assignee: Aisin Seiki Kabushiki Kaisha, Aichi, Japan

[21] Appl. No.: 827,573

[22] Filed: Feb. 10, 1986

[30] Foreign Application Priority Data

| | | | |
|---|---|---|---|
| Feb. 8, 1985 | [JP] | Japan | 60-017645[U] |
| Mar. 28, 1985 | [JP] | Japan | 60-043902[U] |
| Mar. 28, 1985 | [JP] | Japan | 60-043900[U] |
| Mar. 28, 1985 | [JP] | Japan | 60-043901[U] |
| Mar. 28, 1985 | [JP] | Japan | 60-043903[U] |
| Mar. 28, 1985 | [JP] | Japan | 60-043904[U] |

[51] Int. Cl.[4] ..... F02B 77/00

[52] U.S. Cl. ..... 123/198 F

[58] Field of Search ..... 123/198 F, 90.16, 90.27, 123/90.28

[56] References Cited

U.S. PATENT DOCUMENTS

| | | | |
|---|---|---|---|
| 2,019,252 | 10/1935 | Cottingham | 123/198 F |
| 2,098,115 | 11/1937 | Voorhies | 123/198 F |
| 2,394,738 | 2/1946 | Anthony | 123/198 F |
| 2,948,274 | 8/1960 | Wood | 123/198 F |
| 4,050,435 | 9/1977 | Fuller, Jr. et al. | 123/198 F |
| 4,249,489 | 2/1981 | Bruder et al. | 123/198 F |
| 4,284,042 | 8/1981 | Springer | 123/198 F |
| 4,387,680 | 6/1983 | Tsunetomi et al. | 123/198 F |
| 4,556,025 | 12/1985 | Morita | 123/198 F |

FOREIGN PATENT DOCUMENTS

| | | | |
|---|---|---|---|
| 3239941 | 5/1984 | Fed. Rep. of Germany | 123/198 F |
| 57009 | 5/1979 | Japan | 123/198 F |
| 126009 | 7/1984 | Japan | 123/198 F |
| 775368 | 11/1980 | U.S.S.R. | 123/198 F |

*Primary Examiner*—Charles J. Myhre
*Assistant Examiner*—David A. Okonsky
*Attorney, Agent, or Firm*—Sughrue, Mion, Zinn, Macpeak & Seas

[57] ABSTRACT

A cylinder control device for a variable-cylindered engine. The device comprises a body slidable within a bore formed in a block and urged by a spring always in contact with a cam, a plunger mounted in the body and slidable by hydraulic pressure in the direction perpendicular to the direction of sliding of the body, the plunger having a groove which is adapted to be engaged by the upper end of a valve stem 40 and an escape bore which is adapted to be positioned right above the upper end of the valve stem when the plunger is slided to a cylinder-inoperative position; and means for controlling said application of the hydraulic pressure to the plunger under the control of a computer. When the computer provides an instruction for normal operation of the cylinder, the plunger is held at a position where the upper end of the valve stem engages with the groove in the plunger so that, when the cam is rotated, the valve stem is depressed through the body thereby to open the valve port, whereas, when the hydraulic pressure is applied to the plunger so as to urge the plunger to a valve-inoperative position, the upper end of the valve stem escapes into the escape bore in the plunger when the body is depressed by the cam, so that the valve stem is not depressed and the valve is kept closed, thereby keeping the cylinder inoperative.

8 Claims, 9 Drawing Sheets

CYLINDER CONTROL DEVICE FOR VARIABLE-CYLINDERED ENGINE

BACKGROUND OF THE INVENTION

1. Field of the Invention

The present invention broadly relates to a variable-cylindered internal combustion engine such as a direct-type engine which is capable of varying the number of operative cylinders and, more particularly, to a cylinder control device which controls the operation of cylinders in such a variable-cylindered internal combustion engine.

2. Description of the Prior Art

FIGS. 12 and 13 in combination show a known movable-plunger type cylinder control device for a variable-cylindered engine, in different states of operation. In these Figures, a reference numeral 31 denotes a body, while a reference numeral 32 devotes a plunger which is slidably received in a bore 31*a* formed in the body 31. The body 31 is slidably disposed in a bore 36*a* of a block 36 which in turn is interposed between a cam 34 adapted to be rotated by the crackshaft of an engine and a valve stem 40 of valve 35

A reference numeral 37 designates a solenoid valve which is disposed in the oil passage 38, while a numeral 39 denotes a groove formed in the outer periphery of the body 31. A numeral 40 denotes a valve stem. A numeral 41 designates a spring which is loaded between the body 31 and the plunger 32 so as to bias the plunger 32 from the bore 31*a* in the body 31 of the plunger 32. A numeral 42 designates a snap ring which prevents the plunger 32 from coming off the bore 31*a*. A numeral 33 designates a computer which controls the solenoid valve 37 so as to selectively put the cylinder of the engine into operation.

A spring 43 is loaded between the body 31 and a spring retainer 45 which is fixed to the valve stem 40 by means of a cotter 44, while a valve spring 46 is interposed between the retainer 45 and the bottom surface of the bore 36*a* in the block 36. A reference numeral 47 denotes a valve guide, while a numeral 48 designates a groove which is adapted to engage with the upper end of the valve stem 40 during normal operation of the cylinder. A numeral 49 denotes an idle bore into which the upper end of the valve stem 40 escapes when the cylinder of the engine is inoperative, i.e., when the engine operate with reduced number of cylinders. The idle bore 49 is formed vertically in the central portion of the plunger 32.

In the state shown in FIG. 12, the lift of the cam 34 is transmitted through the body 31, plunger 32 and the valve stem 40 to the valve 35 so as to open and close the valve port thereby allowing the cylinder to operate.

When it is desired to reduce the number of the operating cylinders, as in the case of waiting at a crossing for a traffic light, the computer 33 delivers a signal to the solenoid valve 37 associated with the cylinder which is to be put into inoperative state. As a result, the solenoid valve 37 is opened, so that hydraulic pressure is transmitted through the oil passage 38 and the groove 39 to the plunger 32, thereby moving the plunger 32 against the force of the spring 41. As a result, the idle bore 49 is brought to a position just above the valve stem 40. In this state, even though the cam 34 is rotated to depress the body 31, the upper end of the valve stem 40 is received in the idle bore 49 in the plunger 32, so that the lift of the cam 34 is not transmitted to the valve 35.

Thus, the valve port is kept closed, so that this cylinder is kept inoperative, as will be seen from FIG. 13.

This known cylinder control device, however, suffers from various problems.

A first problem resides in that the movement of the plunger 32 to the cylinder-inoperative position is impaired due to stagnation of oil in the portion of the plunger chamber 50 where the spring 41 is received, because there is no means for relieving oil from this portion of the plunger chamber 50.

Another problem resides in that, since the width of the groove 48 in the plunger 32 is too larger as compared with the diameter of the valve stem 40, the wall of the groove cannot serve as an effective means for preventing the rotation of the plunger 32 during assembly or operation due to, for example, vibration. Once the plunger is rotated, the idle bore 49 is circumferentially offset from the position of the valve stem, so that the cylinder cannot be turned into inoperative state.

A third problem resides in that, since the space between the retainer 45 fixed to the valve stem 40 and the body 31 is small, the return spring 43 for upwardly biasing the body 31 into contact with the cam 3 can have only a limited size and, hence, can exert only a limited upward biasing force. In addition, since the force for lifting the valve stem 40 for closing the valve is the difference between the force of the valve spring 46 and the return spring 43, only a small force is available for lifting the valve stem to close the valve. This means that the valve cannot follow the cam during high speed engine operation.

A fourth problem resides in that the plunger 32 has to have a large diameter in order that the idle bore 49 formed therein has a size large enough to receive the upper end portion of the valve stem 40 when the cylinder is in inoperative state. In consequence, the size of the cylinder control device as a whole is increased undesirably. In addition, the large diameter of the plunger requires a large quantity of oil for displacing the plunger.

A fifth problem resides in that, since the bottom surface of the groove 48 in the plunger 32 is flat, the valve clearance is undesirably changed by a slight rotation of the plunger 32 with respect to the valve stem 40, thus impairing smooth operation of the engine.

SUMMARY OF THE INVENTION

Accordingly, a first object of the invention is to provide a cylinder control device for a variable-cylindered engine, which can ensure a smooth movement of the plunger into the cylinder-inoperative position in response to a demand for engine operation with reduced number of cylinders.

A second object of the invention is to provide to provide a cylinder control device for a variable-cylindered engine, which is improved to ensure that the valve stem is correctly received in the idle bore formed in the plunger whenever it is required to turn the cylinder into inoperative state, by preventing any rotation of the plunger due to, for example, vibration, thereby ensuring safe switching of the cylinder into inoperative state.

A third object of the invention is to provide a cylinder control device for variable-cylindered engine, improved to ensure that the valve will follow the cam during high speed engine operation, which hitherto has been often failed due to too small a force for lifting the body and too small a force for depressing the valve.

A fourth object of the invention is to provide a cylinder control device in which the size of the cylinder control device as a whole is reduced by virtue of a reduction in the size of the plunger.

A fifth object of the invention is to provide a cylinder control device in which the problem caused by the flat bottom surface contacted by the upper end of the valve stem is eliminated.

In order to achieve the first object of the invention, there is provided a cylinder control device for a variable-cylindered engine comprising: a body slidable within a bore formed in a block and urged by a spring always in contact with a cam; a plunger mounted in the body and slidable by hydraulic pressure in the direction perpendicular to the direction of sliding of the body, the plunger having a groove which is adapted to be engaged by the upper end of a valve stem and an idle bore which is adapted to be positioned right above the upper end of the valve stem when the plunger is slid to a cylinder-inoperative position; and means for controlling the application of the hydraulic pressure to the plunger under the control of a computer; wherein, when the computer provides an instrucion for normal operation of the cylinder, the plunger is held at a position where the upper end of the valve stem engages with the groove in the plunger so that, when the cam is rotated, the valve stem is depressed through the body thereby to open the valve port, whereas, when the hydraulic pressure is applied to the plunger so as to urge the plunger to a valve-inoperative position, the upper end of the valve stem escapes into the idle bore in the plunger when the body is depressed by the cam, so that the valve stem is not depressed and the valve is kept closed, thereby keeping the cylinder inoperative; wherein the improvement comprises an oil draining hole formed in the bottom portion of the wall of the plunger chamber where the plunger spring is located, so as to permit oil to be drained through the oil draining hole when the plunger is moved to the cylinder-inoperative position by the hydraulic pressure against the plunger spring.

In order to achieve the second object, the invention also provides a cylinder control device for a variable cylindered engine in which the width of the groove formed in the plunger for engagement with the valve stem is determined to be slightly greater than the diameter of the valve stem, so that the valve stem contacts one of the walls of the groove thereby preventing undesirable rotation of the plunger.

In order to achieve the third object of the invention, the invention also provides a cylinder control device for a variable-cylindered engine in which the return spring for upwardly resetting the body is disposed in such a manner as to surround the valve spring for urging the valve stem in the valve closing direction.

In order to achieve the fourth object, there is provided a cylinder control device in which an idle hole is formed in the portion of the body right above the valve stem such that, when the plunger is in the cylinder-inoperative position, the upper end portion of the valve stem is received in the idle bore in the body through the idle bore formed in the plunger.

In order to achieve the fifth object of the invention, the invention provides a cylinder control device in which the bottom surface of the groove formed in the plunger for engagement with the top end of the valve stem is curved concentrically with the outer peripheral surface of the plunger, so that the problem attributable to the flat shape of the groove bottom surface is obviated.

The above and other objects, features and advantages of the invention will become clear from the following description of the preferred embodiments when the same is read in conjunction with the accompanying drawings.

BRIEF DESCRIPTION OF THE PREFERRED EMBODIMENTS

DESCRIPTION OF THE PREFERRED EMBODIMENTS

Figure 1:
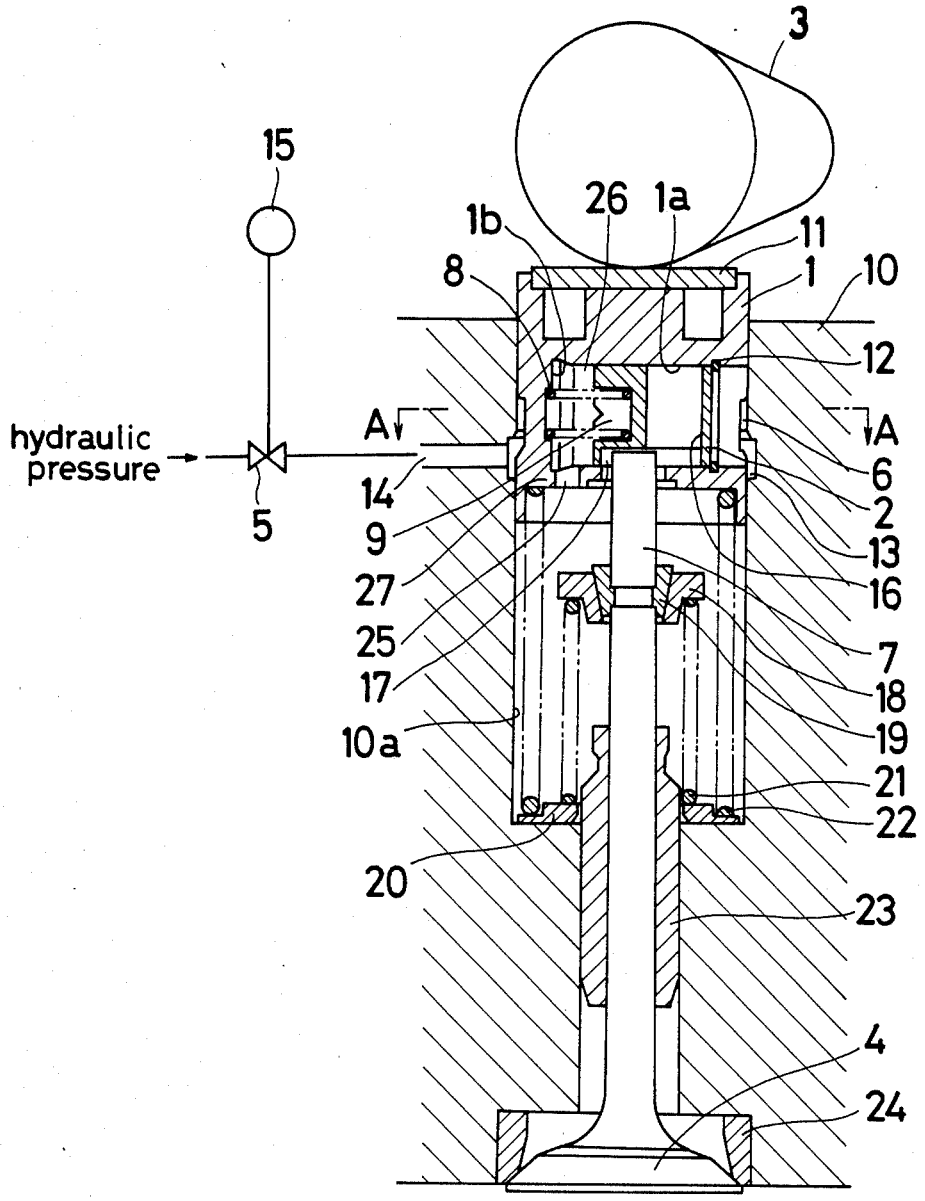
FIG. 1 is a vertical sectional view of a first embodiment of a cylinder control device of the invention for controlling the operation of a variable-cylindered engine.

A first embodiment of the invention will be described hereinunder with specific reference to FIGS. 1 to 3. Referring to these Figures, a cylinder control device of the first embodiment has a body 1, and a plunger slidably received in a bore 1*a* formed in the body 1. The body 1 is slidably received in bore 10*a* formed in a block 10 which is interposed between the cam 3 and the valve 4. A numeral 5 denotes a solenoid valve which is disposed in an oil passage 14. A groove 6 is formed in the outer peripheral surface of the body 1. A reference numeral 7 designates a valve stem which is provided at its lower end with the valve 4. The plunger 2 is biased outwardly of the bore 1a in the body 1, i.e., to the right as viewed in FIG. 1, by the force of a spring 8 which is disposed in the portion of the bore 1*a* between the plunger 2 and the bottom 1*b* of the bore 1*a*.

A reference numeral 9 denotes a hole formed in the plunger so as to receive the spring 8. The arrangement is such that, when the plunger has been displaced leftward as viewed in FIG. 1 into the cylinder-inoperative position where the plunger 2 contacts the bottom 1*b* in the bore 1*a*, the spring 8 is completely accommodated by the hole 9. When the plunger 2 is in the above-mentioned cylinder-inoperative position, an idle bore 16 formed in the plunger 2 is positioned right above the valve stem 7 coaxially therewith. The idle bore 16 has a diameter greater than that of the valve stem 7, so that, when the upper end portion of the valve stem 7 is received in the idle bore 16 as will be explained later, a minute annular gap is formed between the wall of the idle bore 16 and the valve stem 7 thereby avoiding mutual contact therebetween. The plunger 2 also has a groove 17 which has a width slightly greater than the diameter of the upper end portion of the valve stem 7 and adapted to be engaged with the upper end portion of the valve stem 7 during the normal operation of the cylinder, i.e., when the cylinder is in the operative state as shown in FIG. 1.

The cam 3 is adapted to depress the body 1 through a plate 11 fixed to the upper surface of the body 1 and held in contact with the cam 3. A snap ring 12 prevents the plunger 2 from coming out of the bore 1a in the body 1 by the force of the spring 8. A reference numeral 13 designates a groove which is formed in the inner peripheral surface of the bore 10a in block 10 and disposed in communication with the oil passage 14, while a numeral 15 denotes a computer which controls the state of the solenoid valve 5 and, hence, to change-over the state of the cylinder. A reference numeral 18 denotes a retainer which is fixed to the valve stem 7 through a cotter 19, while a numeral 20 denotes another retainer seated on the bottom of the bore **10*a* in the block 10. A valve spring 21 acts between these two retainers 18 and 20. On the other hand, a body return spring 22 acts between the retainer 20 and the body 1 so as to urge the body 1 into continuous contact with the cam 3. A numeral 23 denotes a valve guide 23, while 24 designates a valve seat which is adapted to be contacted by the valve 4**.

The first embodiment is characterized by the provision of an oil draining hole 25 which is formed in a lower plate 27 constituting the bottom of the portion of the bore 26 in the body 1 receiving the plunger 2.

The operation of the first embodiment described hereinbefore is as follows.

In the state shown in FIG. 1, the lift of the cam 3 is transmitted to the valve 4 through the plate 11, body 1, plunger 2 and the valve stem 4, so that the valve 4 is moved into and out of contact with the valve seat 24 thereby opening and closing the valve port, so that the cylinder is operative.

Figures 2, 3:
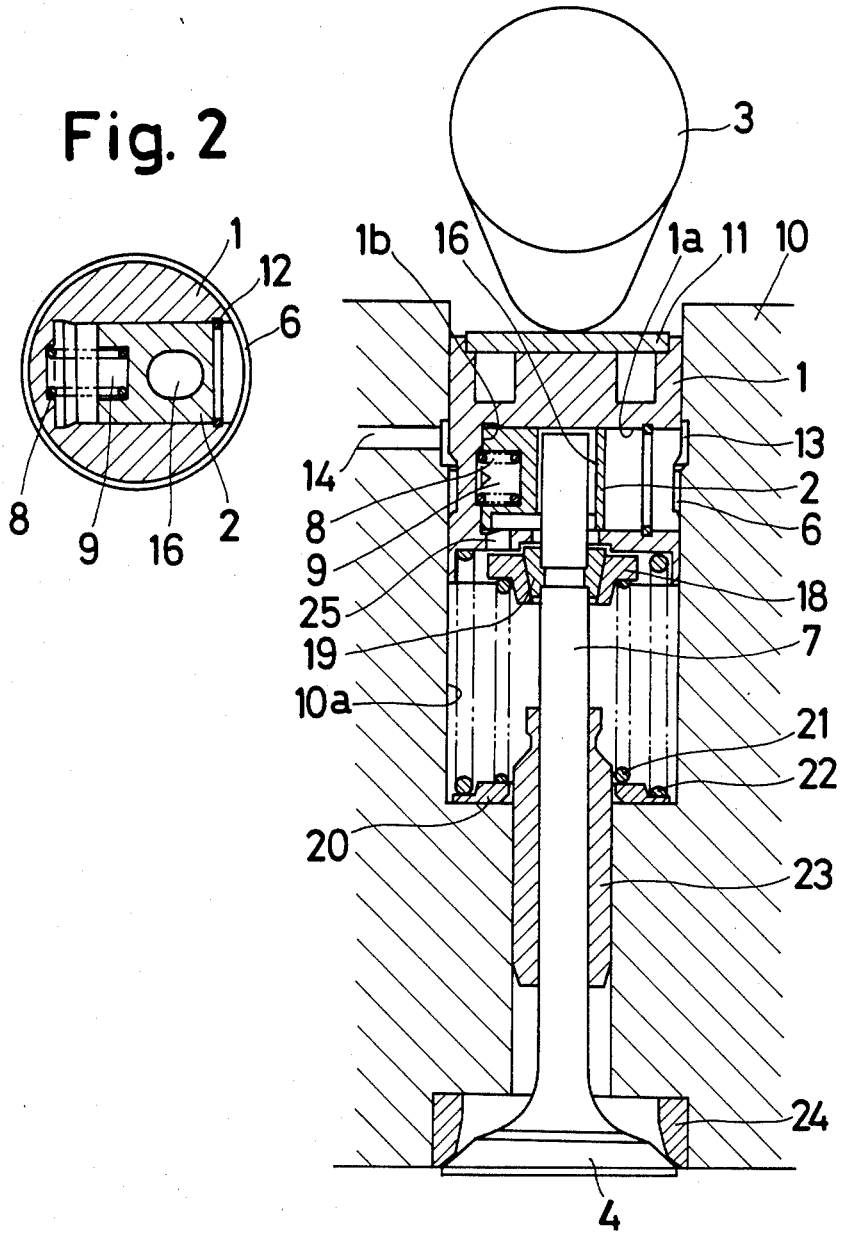
FIG. 2 is a sectional view taken along the line A—A in FIG. 1.
FIG. 3 is a sectional view of the first embodiment shown in FIG. 1 in a different state of operation.

In contrast, in the state shown in FIG. 3 in which the cylinder is inoperative, the solenoid valve 5 is opened in response to the signal from the computer 15 so that the oil pressure is transmitted to act on the plunger 2 through the oil passage 14, groove 13 and the groove 6. As a result, the plunger 2 is moved to the left into the cylinder-inoperative position against the force of the spring 8 until it contacts the bottom **1*b* of the bore 1*a* in the body 1. When the plunger 2 moves to the cylinder-inoperative position, the oil in the portion of the bore 1*a* in the body 1 where the spring 8 is disposed and displaced by the plunger 2 so as to be drained through the oil draining hole 25 completely. When the plunger 2 is in the cylinder-inoperative position, the idle bore 16 is positioned right above the valve stem 7 coaxially therewith, so that, when the body 1 and together with the plunger 2 is depressed by the cam 3, the upper end portion of the valve stem 7 is received in the idle bore 16. In consequence, the valve stem 7 is not depressed despite the operation of the cam 3 which depresses the main body 1, so that the valve 4 is held in contact with the valve seat 24** thereby keeping the cylinder inoperative.

In the first embodiment described hereinbefore, the oil accummulated in the portion of the bore formed in the body accommodating the spring acting of the plunger is displaced by the plunger and is drained completely through the oil draining port formed in the bottom portion of the bore mentioned above, when the plunger is moved into the cylinder-inoperative position in response to a demand for the reduction in the number of operative cylinders. It is thus possible to smooth the movement of the plunger into the cylinder-inoperative position and, hence, to attain a quick response to the demand for engine operation with reduced number of operative cylinders.

Figure 4:
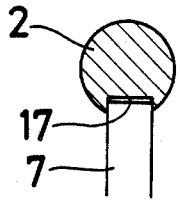
FIG. 4 is a sectional view of an essential portion of a second embodiment of the invention.

A second embodiment will be described hereinunder, with specific reference to FIG. 4. In this second embodiment, as will be seen from FIG. 4, the groove 17 formed in the plunger 2, which receives the upper end portion of the valve stem 7 during normal operation of the cylinder, has a width which is slightly greater than the diameter of the valve stem 7 so that one of the side walls of the groove 17 contacts the valve stem 7 so as to serve as a stopper which prevents the plunger 2 from rotating. Therefore, the rotation of the plunger 2 during normal operation of the cylinder is prevented, so that the valve stem 7 is received in the idle bore without fail when the plunger 2 is moved to the cylinder-inoperative state, thus ensuring the switching of the cylinder into inoperative state when there is such a demand.

Other portions of the second embodiment are materially identical to those of the first embodiment, so that further description of the second embodiment is omitted.

Figure 5:
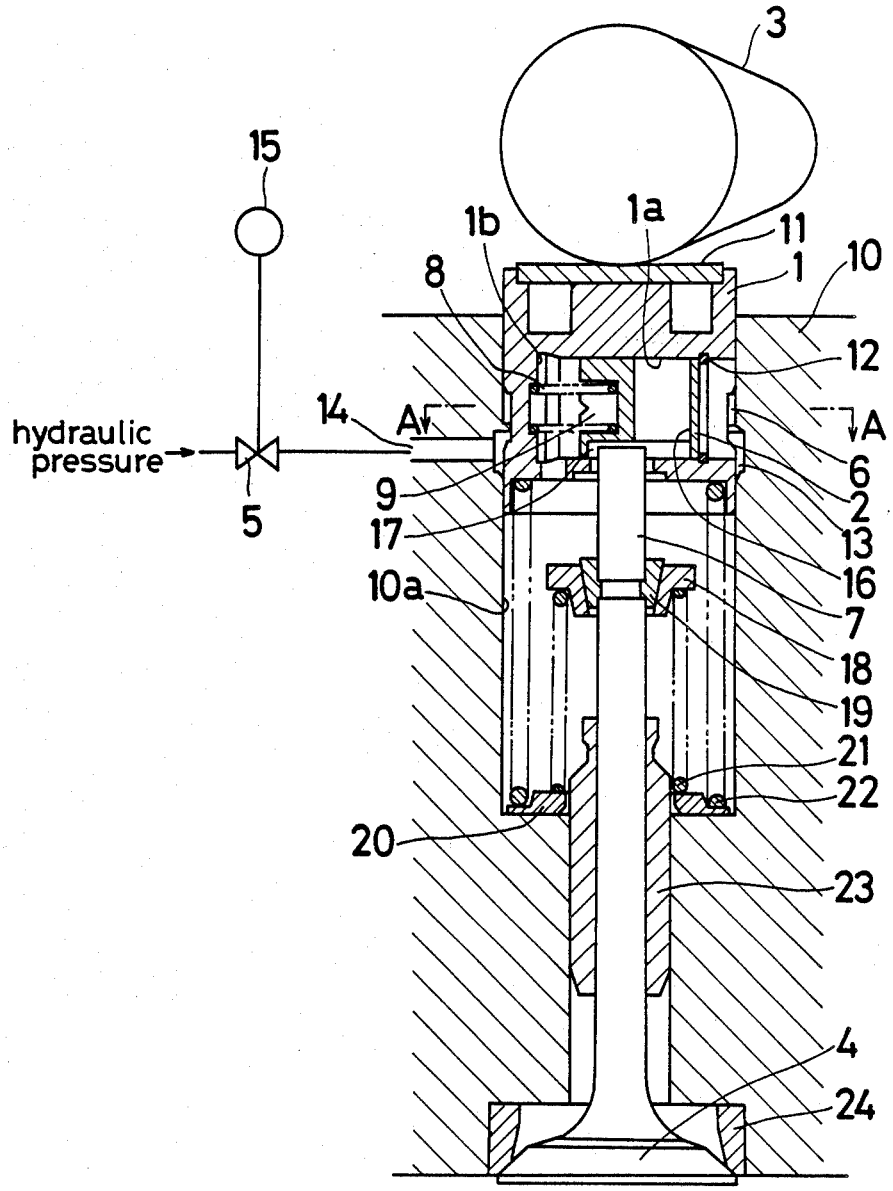
FIG. 5 is a vertical sectional view of a third embodiment of a cylinder control device in accordance with the invention.

A third embodiment of the invention will be described hereinunder with specific reference to FIG. 5. In this third embodiment, the return spring 22 for upwardly urging the body 1 into contact with the cam 3 is disposed to act between the retainer 20 and the body 1 in such a manner as to surround the valve spring 21 which exerts the force for urging the valve stem 7 in the valve closing direction. In this embodiment, since the space between the retainer 20 and the body 1 is large, the return spring 22 in this space can have a sufficiently large size and, hence, can exert a large force, while the force of the valve spring 21 can be fully utilized in urging the valve stem 7 in the valve closing direction, in contrast to the known arrangement explained before. In consequence, the valve can well follow-up high speed operation of the engine, thus achieving the third object of the invention. Other portions of the third embodiment are materially identical to those of the preceding embodiments, so that detailed description will be needed in this connection.

Figure 6:
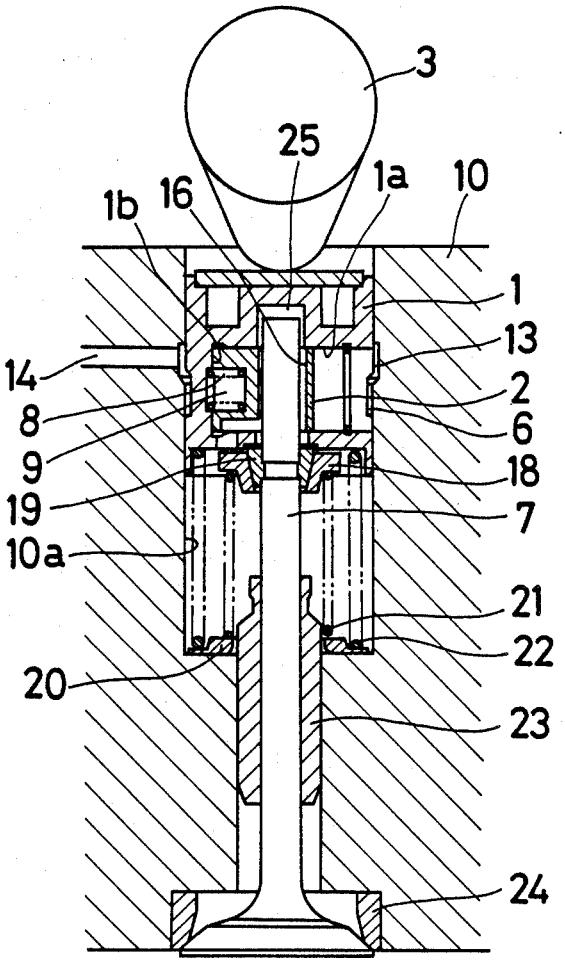
FIG. 6 is a vertical sectional view of a fourth embodiment of the invention.

A fourth embodiment of the invention will be described with reference to FIG. 6.

As will be seen from this Figure, an idle bore 25 is formed in the wall of the body 1 on the upper side of the plunger at a position right above the valve stem 7. The idle bore 25 has a size slightly greater than the diameter of the valve stem 7. In addition, the idle bore 16 in the plunger 2 is formed as a through bore. The arrangement is such that, when the plunger is in the cylinder-inoperative position, the idle bore 25 in the body 1 and the idle bore 16 in the plunger are aligned and communicated with each other so that the upper end portion of the valve stem 7 is received in the idle bore 25 in the body 1 through the idle bore 16 in the plunger 2. With this arrangement, since the idle bore 16 formed in the plunger 2 is a through bore, the diameter of the plunger 2 can be reduced. This also permits the quantity of oil required for displacing the plunger 2 to be reduced, so that the size and capacity of the hydraulic system can be reduced advantageously. Since the idle bore 25 is formed in the fixed body 1, and since it has a size greater than the diameter of the valve stem 7, there is no risk of friction.

Figure 7:
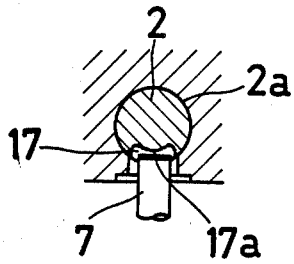
FIG. 7 is a sectional view of an essential portion of a fifth embodiment of the invention.

A fifth embodiment of the invention will be described hereinunder with reference to FIG. 7. As will be seen from this Figure, the bottom surface 17*a* of the groove 17 formed in the plunger 2, which surface being contacted by the top end surface of the valve stem 7 during normal operation of the cylinder, is curved concentrically with the outer peripheral surface 2*a* of the plunger 2. Therefore, even when the plunger is rotated undesirably due to, for example, vibration, the distance between the bottom surface 17*a* of the groove and the top end surface of the valve stem 7 is not changed, thus ensuring a constant lift of the valve.

Figures 8, 9:
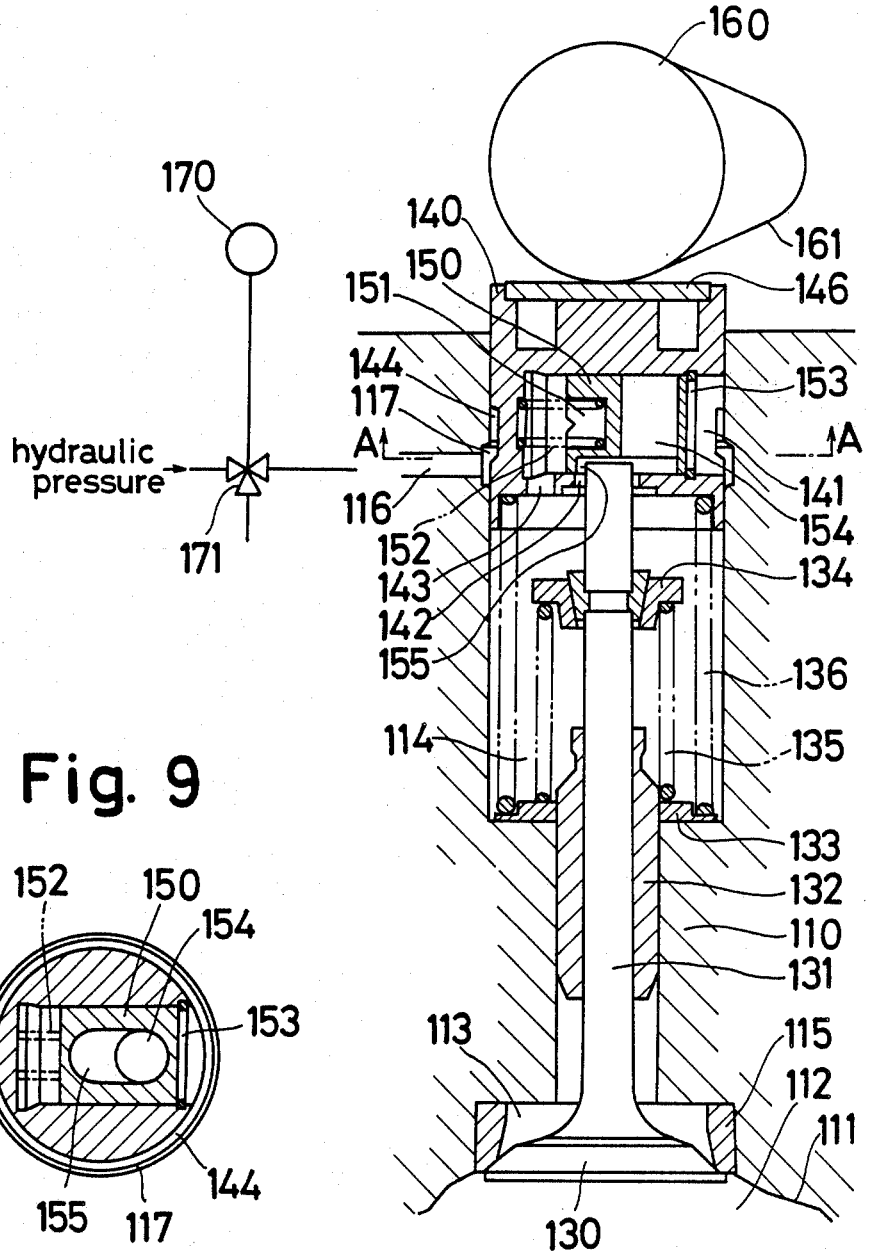
FIG. 8 is a vertical sectional view of a sixth embodiment in the state of normal operation of the cylinder.
FIG. 9 is a view taken along the arrow line A—A in FIG. 8.
Figures 10, 11:
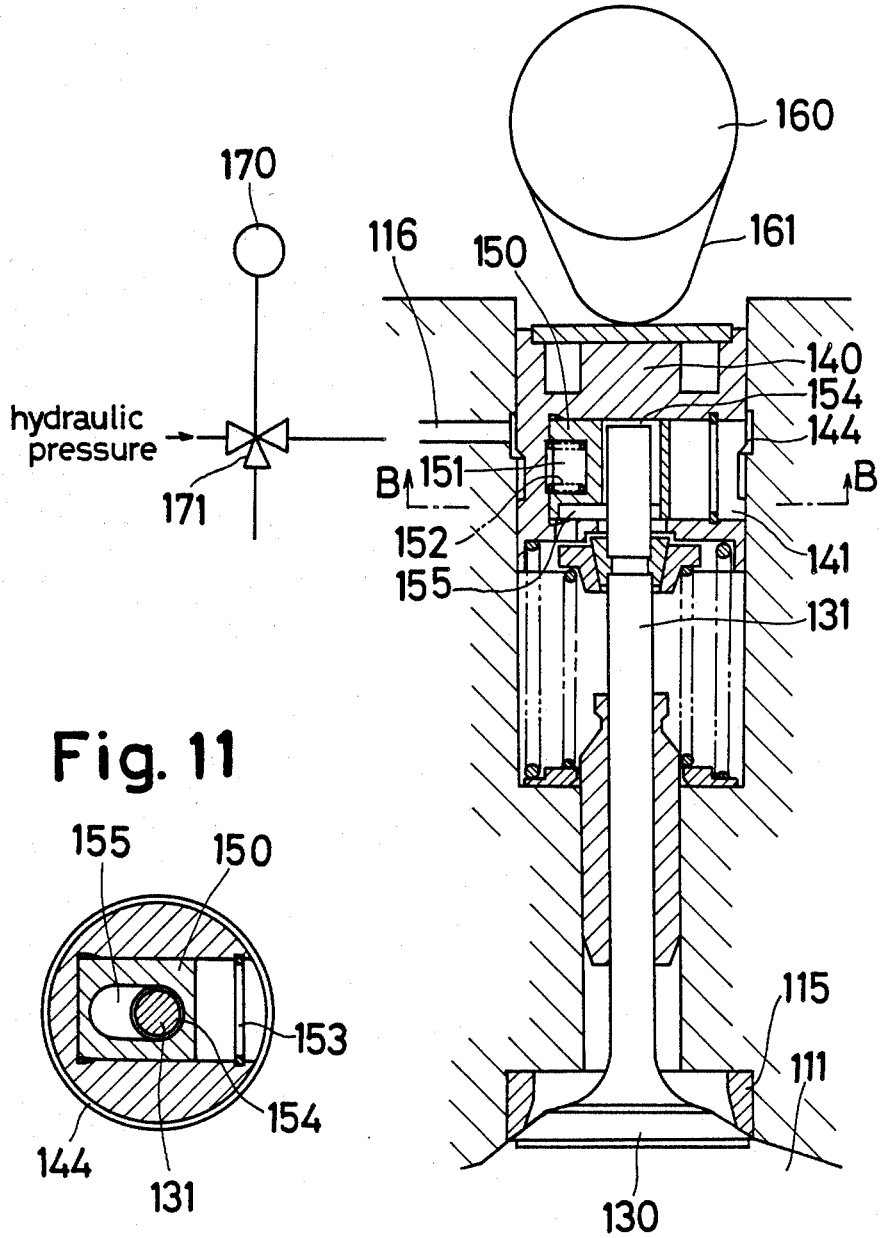
FIG. 10 is a vertical sectional view of the sixth embodiment in the dylinder-inoperative state.
FIG. 11 is a view taken along the arrow line B—B in FIG. 10.
Figure 12:
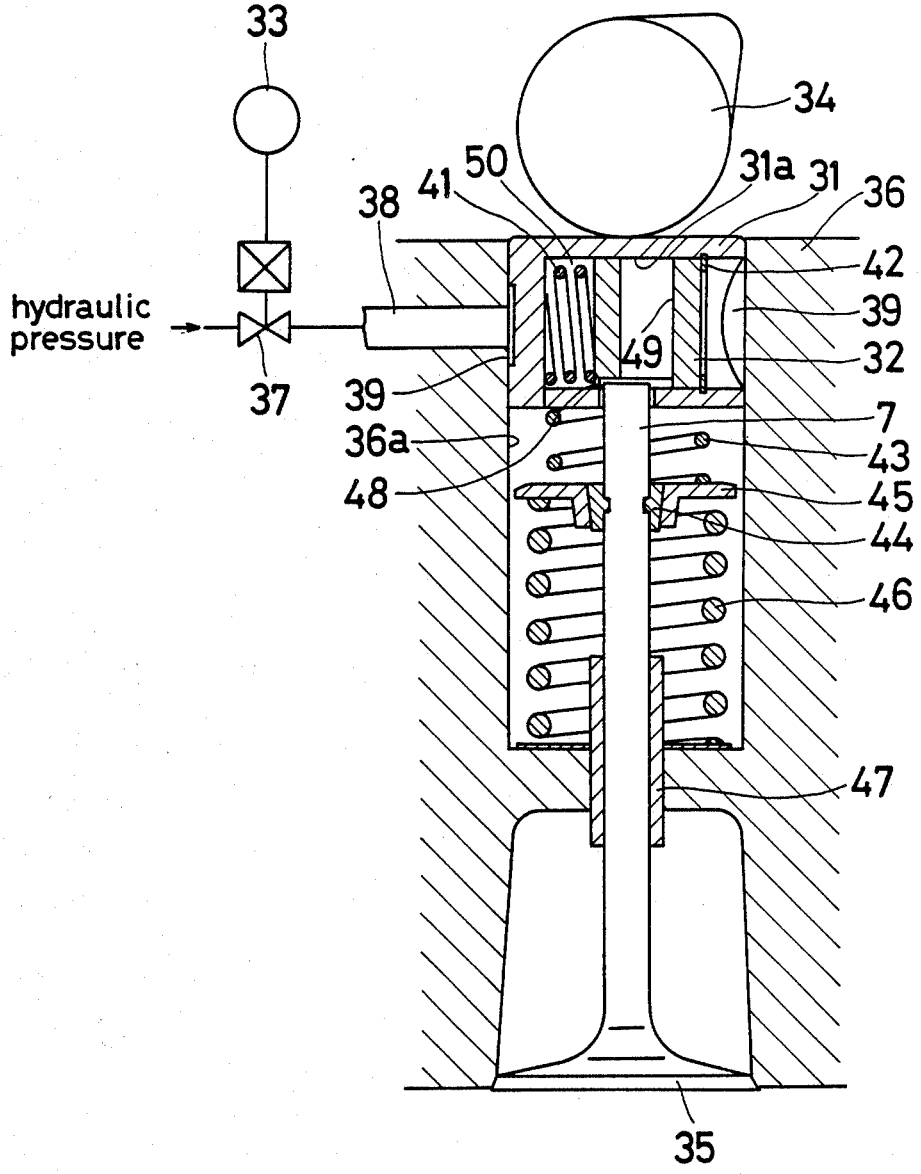
Fig. 12 PRIOR ART
FIG. 12 is a vertical sectional view of a conventional cylinder control device in the state of normal operation of the cylinder.
Figure 13:
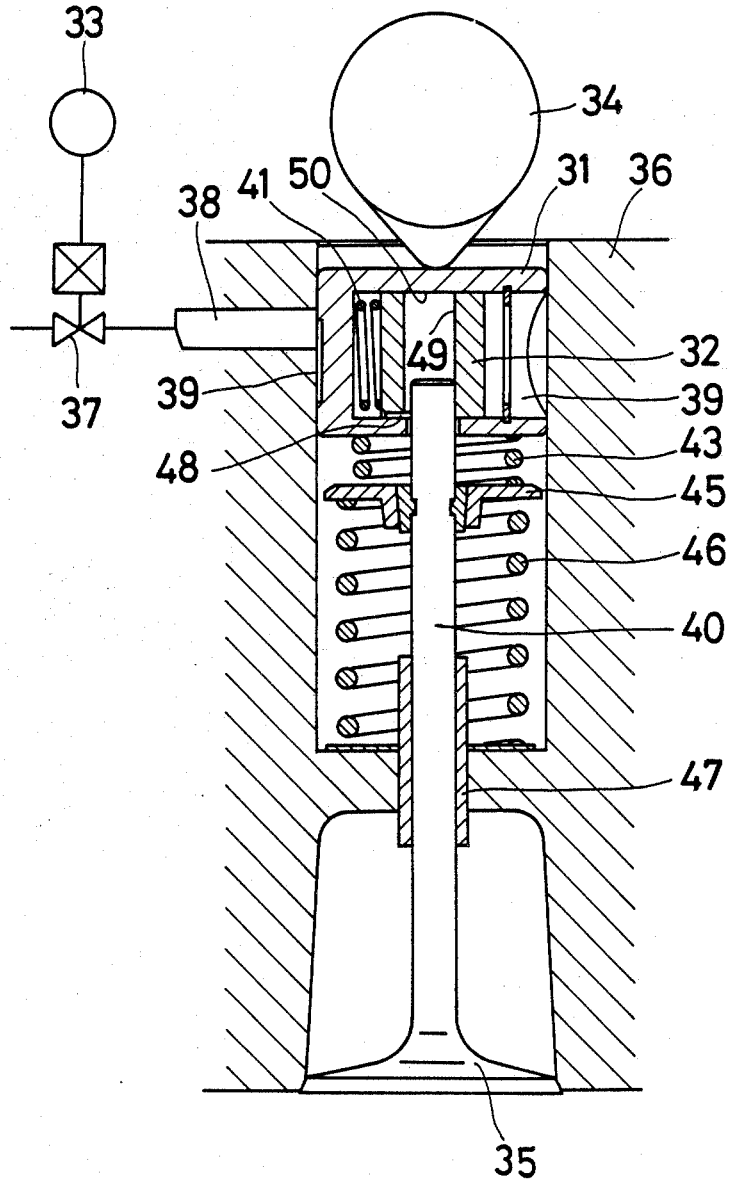
Fig. 13 PRIOR ART
FIG. 13 is a vertical sectional view of the conventional cylinder control device in the cylinder-inoperative state.

A sixth embodiment of the cylinder control device in accordance with the invention will be described hereinunder with specific reference to FIGS. 8 and 11.

A piston (not shown) is adapted to reciprocate in the vertical direction in a cylinder 111 formed in the cylinder block 110. The communication between a combustion chamber 112 on the piston and an intake or exhaust port 113 is controlled by a valve 130. The valve 130 is formed as a unit with a columnar valve stem 131. The valve stem 131 is slidably received in the valve guide 132 formed in the cylinder block 110. The cylinder block 110 is provided with a cylindrical bore 14 of a diameter slightly greater than the diameter of the valve guide 132. The cylindrical bore 114 is formed on the upper side of the valve guide 132 and coaxially with the same. A valve spring 135 is stretched between a spring seat 133 formed on the bottom of the bore 114 and a spring retainer 134 which is fixed to a portion of the valve stem 131 near one end thereof. The valve spring 135 normally biases the valve 130 upwardly so that the valve 130 is always seated on the valve seat 115.

A columnar housing 140 is disposed above the valve stem 131 and is slidably received in the bore 114. A housing spring 136 is stretched between the housing 140 and the spring seat 133 so as to normally urge the housing 140 upwardly.

A parallelepiped plunger chamber 141 is formed in the housing 140. The plunger chamber 141 extends perpendicularly to the axis of the valve stem 131 and opens at its one end in one lateral side of the housing 140 while the other end is closed. A stem bore 142 communicating with the plunger chamber 141 is formed in the lower end surface of the housing 140 facing the valve stem 131. An air hole 143 also is formed in the lower end surface of the housing 140. The arrangement is such that one end of the valve stem 131 projects into the plunger chamber 141 through the stem bore 142. A plate 146 fixed to the upper end surface of the housing 140 is held in contact with the cam surface 161 of the cam shaft 160 by the urging force exerted by the housing spring 136.

A circumferential housing groove 144 is formed in the outer peripheral surface of the housing 140. An oil passage 116 is formed in the clinder block 110 such as to introduce pressurized lubricating oil. An oil groove 117 formed in the inner surface of the bore 114 at least partially overlaps the housing groove 144 even when the housing 140 is moved vertically. Thus, the oil passage 116 is always held in communication with the plunger chamber 141.

The plunger chamber slidably accommodates a plunger 150 which extends in the axial direction of the plunger chamber 141.

The plunger 150 has a spring hole 151 which opens towards the bottom of the plunger chamber 141. A spring 152 is fixed at its one end fo the bottom of the plunger chamber 141 and contacts at its other end with the bottom of the spring hole 151. The spring 151 therefore urges the plunger 150 towards the open end of the plunger chamber 141. A snap ring 153 fixed to the open end of the plunger chamber 141 so as to limit the outward movement of the plunger 150.

The plunger 150 has a cylindrical idle bore 154 which extends through the plunger 50 in the axial direction of the valve stem 131. The idle bore 154 has a diameter which is substantially equal to the diameter of the plunger 150. An oval recess 155 containing the opening of the idle bore 154 is formed in the lower end surface of the plunger 50. The depth of the recess 155 is slightly greater than the height by which the end of the valve stem 131 projects above the stem bore 142 as the valve stem 131 is biased by the valve spring 135.

When the plunger 150 is depressed so as to compress the spring 152, the plunger moves until the brim portion of the spring bore 151 contacts the bottom of the plunger chamber 141. Meanwhile, air escapes through the air hole 143. In this state, the valve stem 131 and the idle bore 154 are coaxial with each other so that the valve stem 131 becomes able to move into the idle bore 154. Needless to say, the spring 152 produces a force which is smaller than the biasing force which is produced by the engine oil pressure applied to the opposite end of the plunger 150 through the oil passage 116, oil groove 117 and the housing groove 144. When the oil pressure is not transmitted, the plunger 150 is retained with its one end kept in contact woth the snap ring 153. In this state, the bottom surface of the recess 155 faces the top of the valve stem 131.

The operation of the sixth embodiment will be described hereinunder. During the operation of the cylinder, the oil pressure is not transmitted through the oil passage 116, so that the plunger 150 is urged by the spring 152 into the opening in the plunger chamber 141, so that the bottom surface of the recess 155 faces the end surface of the valve stem 131. When the cam shaft 160 rotates in this state so as to depress the housing 140, the bottom surface of the recess 155 contacts the end surface of the valve stem 131 thereby depressing the valve stem 131. In consequence, the valve 130 leaves the valve seat 115 so that the cylinder 111 sucks a mixture or discharges an exaust gas. Then, the valve stem 131 and the housing 140 are returned by the forces produced by the valve spring 135 and the housing spring 136. Any thermal expansion or clearance generated in the valve lift mechanism during operation of the engine is absorbed by the gap between the bottom surface of the recess 155 and the end surface of the valve stem 131, as well as by the valve spring 135 and the housing spring 136, thus assuring a constant size of the valve lift mechanism.

Any reduction in the load on the engine is detected by a computer 170 which senses, for example, the intake vacuum, vehicle speed, throttle opening and so forth. The computer 70 then activates a solenoid valve 171 so as to allow the oil pressure to be transmitted to the open end of the plunger chamber 141 through the engine oil passage 161 and the housing groove 144. As a result, the oil pressure produces a force which exceeds the biasing force of the spring 152, so that the plunger 150 is moved until the rim portion of the spring bore 151 which acts as a stopper is stopped by the bottom of the plunger chamber 141. Consequently, the valve stem 131 becomes able to come into the idle bore 154, so that the depressing force produced by the cam shaft 160 is not transmitted to the valve stem 131. In consequence, the valve 130 is kept seated on the valve seat 151, so that the cylinder 111 does not perform suction nor exhaust. The force of the spring is selected to be small enough so that it does not exceeds the force produced by the oil pressure even when the oil pressure is minimized due to pressure fluctuation. Therefore, the plunger 150 is kept in contact with the bottom of the plunger chamber 141, thus obviating any inconvenience such as damaging due to interference between the valve stem 131 and the idle bore 154 or the recess 155.

What is claimed is:

1. A cylinder control device for a variable cylindered engine comprising: a body having a bottom wall slidable within a bore formed in a block and adapted to be urged by a spring contacting said bottom wall into constant contact with a cam; a plunger slidably mounted in a plunger chamber in the body and slidable by hydraulic pressure in a first direction perpendicular to the direction of sliding of the body, a plunger spring disposed in said plunger chamber for biasing said plunger in a second direction opposite said first direction, the plunger having a groove which is adapted to be engaged by the upper end of a valve stem which extends through an opening in said bottom wall and an idle bore which is adapted to be positioned directly above the upper end of the valve stem when the plunger is slid to a cylinder inoperative position; and means for controlling the application of the hydraulic pressure to the plunger under the control of a computer; wherein, when the computer provides an instruction for normal operation of the cylinder, the plunger is held by the plunger spring at a position where the upper end of the valve stem engages with the groove in the plunger so that, when the cam is rotated, the valve stem is depressed through engagement with the plunger in the body thereby to open a valve port, whereas, when the hydraulic pressure is applied to the plunger so as to urge the plunger against the plunger spring to a valve inoperative position, the upper end of the valve stem escapes into the idle bore in the plunger when the body is depressed by the cam, so that the valve stem is not depressed and the valve is kept closed, thereby keeping the cylinder inoperative; said plunger further comprising an oil draining hole formed in the bottom of the plunger chamber where the plunger spring is located, so as to permit oil to be drained through the oil draining hole when the plunger is moved to the cylinder-inoperative position by the hydraulic pressure against the plunger spring.

2. A cylinder control device according to claim 1, wherein the width of the groove formed in the plunger for engagement with the valve stem is determined to be slightly greater than the diameter of the valve stem, so that the valve stem contacts one of the walls of the groove thereby preventing undesirable rotation of the plunger.

3. A cylinder control device according to claim 1, further comprising a return spring for upwardly resetting the body disposed in such a manner as to surround a valve spring for urging the valve stem in the valve closing direction.

4. A cylinder control device for a variable-cylindered engine comprising:

a valve member for selectively allowing a combustion chamber in a cylinder of said engine to be communicated with a port;

said valve member including a stem portion having a longitudinal axis and formed integrally with said valve member and slidably held by said cylinder head;

and a connecting portion adapted to be pressed in the axial direction of said stem portion by a pressing member, so as to transmit the axial movement of said pressing member to said stem portion thereby opening and closing said valve member;

wherein said connecting portion includes:

a housing disposed on an upper end portion of said stem portion and movable in the axial direction of said stem portion, said housing adapted to be biased away from said stem portion and having a plunger chamber which extends in a direction perpendicular to said axis of said stem portion;

a plunger slidably received in said plunger chamber and adapted to be urged in one direction by a fluid pressure introduced into said plunger chamber, said plunger having an idle bore capable of receiving the upper end portion of said stem portion and a contact surface adapted to be contacted by an upper end surface of said stem portion; and a stopper disposed on one end of said plunger and adapted to stop said plunger at a position where said upper end portion of said stem portion can come into said idle bore, when said plunger has been urged by said fluid pressure; and an urging member in said plunger chamber acting between said housing and said plunger for urging said plunger in a direction opposite to the direction of the force produced by said fluid pressure;

wherein, when said fluid pressure is applied to said plunger, said plunger is moved until it is stopped by said stopper so that the upper end portion of said stem portion can come into and out of said idle bore, such that the axial movement of said pressing member is absorbed by the movement of said connecting portion relative to said stem portion, thereby allowing said stem portion and said valve member to be fixed, whereas, when said fluid pressure is relieved, said plunger is urged by said urging member to a position wherein said contact surface on said plunger is contacted by the upper end surface of said stem portion, whereby the movement of said pressing member is transmitted to said stem portion and said valve member, thereby allowing said valve member to open and close; said housing further including an oil draining hole in communication with said plunger chamber containing said urging member so as to permit oil to be drained through said oil draining hole when the plunger is moved to the cylinder inoperative position by the fluid pressure against said urging means.

5. A cylinder control device according to claim 4, wherein said housing of said connecting portion has a cylindrical form and is provided in the outer peripheral surface thereof with a circumferental groove for introducing said fluid pressure.

6. A cylinder control device according to claim 4, wherein said plunger chamber is opened at one end while the other end is closed, said urging member being a spring loaded between a bottom of said plunger chamber and said one end of said plunger.

7. A cylinder control device according to claim 6, wherein said one end of said plunger is provided with a central hole having a bottom contacted by one end of said spring, the rim portion about said central hole constituting said stopper.

8. A cylinder control device for a variable cylindered engine comprising: a body having a bottom wall slidable within a bore formed in a block and adapted to be urged by a spring contacting said bottom wall into constant contact with a cam; a plunger slidably mounted in a plunger chamber in the body and slidable by hydraulic pressure in a first direction perpendicular to the direction of sliding of the body, a plunger spring disposed in said plunger chamber for biasing said plunger in a second direction opposite said first direction, the plunger having a groove which is adapted to be engaged by the upper end of a valve stem which extends through an opening in said bottom wall and an idle bore which is adapted to be positioned directly above the upper end of the valve stem when the plunger is slid to a cylinder inoperative position; and means for controlling the application of the hydraulic pressure to the plunger under the control of a computer; wherein, when the computer provides an instruction for normal operation of the cylinder, the plunger is held by the plunger spring at a position where the upper end of the valve stem engages with the groove in the plunger so that, when the cam is rotated, the valve stem is depressed through engagement with the plunger in the body thereby to open a valve port, whereas, when the hydraulic pressure is applied to the plunger so as to urge the plunger against the plunger spring to a valve inoperative position, the upper end of the valve stem escapes into the idle bore in the plunger when the body is depressed by the cam, so that the valve stem is not depressed and the valve is kept closed, thereby keeping the cylinder inoperative; wherein the plunger is cylindrical and wherein the bottom surface of the groove formed in the plunger for engagement with the top end of the valve stem is curved concentrically with the outer peripheral surface of the plunger.

* * * * *